US006104363A

United States Patent [19]

Kobayashi et al.

[11] Patent Number: 6,104,363

[45] Date of Patent: Aug. 15, 2000

[54] DISPLAY ELEMENT DRIVING METHOD

[75] Inventors: Makoto Kobayashi; Haruo Kawakami; Yotaro Shiraishi, all of Kanagawa, Japan

[73] Assignee: Fuji Electric Co., Ltd., Kawasaki, Japan

[21] Appl. No.: 08/865,178

[22] Filed: May 29, 1997

[30] Foreign Application Priority Data

May 29, 1996 [JP] Japan ..... 8-156335

[51] Int. Cl.[7] ..... G09G 3/30

[52] U.S. Cl. ..... 345/76; 345/78

[58] Field of Search ..... 345/60, 76, 78

[56] References Cited

U.S. PATENT DOCUMENTS 5,568,417 10/1996 Furuki et al. ..... 365/106
5,594,463 1/1997 Sakamoto ..... 345/76
5,828,181 10/1998 Okuda ..... 345/77

FOREIGN PATENT DOCUMENTS 0 349 265 1/1990 European Pat. Off. .
06301355 10/1994 Japan .

*Primary Examiner*—Richard A. Hjerpe
*Assistant Examiner*—Duc Dinh
*Attorney, Agent, or Firm*—Kaensaka & Takeuchi

[57] ABSTRACT

In a method for driving an organic light-emitting display element, the element has a reduced possibility of sticking and a long life without reducing the brightness. In the method for driving a display element having the organic light-emitting element emitting light by a current passing through the organic thin film, a voltage VC applied to the cathode of the organic light-emitting element and a voltage VA applied to the anode of the organic light-emitting element are applied to each surface of the organic thin film through two lines that cross each other. Also, the display of the pixel in the intersection of the two lines is controlled by electric signals through the two lines. During a period of time in which each pixel is unlighted, a recovery voltage within a specified range is applied to the pixel for a specified period of time or longer.

4 Claims, 10 Drawing Sheets

7 ANODE PATTERN

8 ORGANIC LAYER PATTERN

9 CATHODE PATTERN

DISPLAY ELEMENT DRIVING METHOD

BACKGROUND OF THE INVENTION AND RELATED ART STATEMENT

The present invention relates to a method for driving a display element comprising an organic light-emitting element that emits light by passing a current through an organic thin film.

In recent years, the research of organic light-emitting elements has been activated due to the low drive voltage required to emit light and the possibility of selecting light-emitting colors through the application of various light-emitting materials (for example, U.S. Pat. No. 3,530,325). Such research has been accelerated since it was reported that a laminated organic light-emitting element formed of an anode/positive hole injection layer/light-emitting layer/cathode is used to achieve a brightness of 1,000 cd/m$^2$ or higher at a drive voltage of 10 V or lower (U.S. Pat. No. 4,356,429).

In addition, in recent years, active attempts have been made to form a display panel by arranging elements in a matrix (for example, Japanese Patent Application Laid Open No. 2-66873 corresponding to U.S. patent application Ser. No. 211,616 filed on Jun. 27, 1988, and Japanese Pat. Application Laid Open No. 2-148687).

A major problem of an organic light-emitting element is that the light-emission brightness decreases with increasing a period of lighted time. In particular, the brightness decreases rapidly if the voltage applied to the element is constant. This is primarily because the internal resistance of the element increases with an increase of a period of a lighted time, thereby reducing the amount of current. This in turn causes the sticking of a display panel comprising the organic light-emitting elements.

To prevent such sticking, a pixel of the organic light-emitting element may be driven at a constant current. This may mitigate the speed at which the brightness decreases. The constant current drive method, however, does not eliminate the cause of the increase in the internal resistance of the element, and changes still occur inside the element that prevents the light emission.

Thus, an object of this invention is to provide a method of driving an organic light-emitting element-display element that reduces a possibility of sticking, that can prevent brightness from being reduced, and that has a long life expectancy.

SUMMARY OF THE INVENTION

After conducting examinations to solve the above problem, the inventors have found that the above object can be achieved in an organic light-emitting element-display panel that emits light by passing a current through an organic thin film. In a method for driving a display element, a voltage VC applied to the cathodes of the organic light-emitting elements and a voltage VA applied to the anodes of the organic light-emitting elements are applied to the organic thin film through two lines that cross each other, and the display of the pixel in the intersection of the two lines is controlled by electric signals through the two lines. In this method, a specific range of a recovery voltage is applied to each pixel for a specified period of time or longer during the non-lighting period of time of each pixel. This invention has thus been completed.

The display-element drive method according to the invention is explained, as follows:

(1) In a method for driving a display element comprising an organic light-emitting element that emits light by passing a current through an organic thin film, a voltage VC applied to the cathodes of the organic light-emitting elements and a voltage VA applied to the anodes of the organic light-emitting elements are applied to each surface of the organic thin film through two lines that cross each other, and wherein the display of the pixel in the intersection of the two lines is controlled by electric signals through the two lines. In the method, there is a period of time during which the voltage applied to the pixel meets the following conditions:

$$0 < V(t(Aon, Con)) \leq V1 \quad (1)$$

$$V(t(Aon, Coff)) \leq V3 \quad (2)$$

$$V(t(Aoff, Con)) \leq -V2 \quad (3)$$

$$-V4 \leq V(t(Aoff, Coff)) \leq -V2, \quad (4)$$

wherein:

V(t): Voltage applied to the pixel (function of time (t));

t (Aon, Con): Period of time during which the pixel emits light;

t (Aoff, Con): Period of time during which a light-emitting pixel is included on the cathode line of the pixel;

t (Aon, Coff): Period of time during which a light emitting pixel is included on the anode line of the pixel;

t (Aoff, Coff): Period of time during which a light-emitting pixel is not included on the anode or cathode line of the pixel;

V1: Voltage for obtaining the required brightness of the pixel of the display element (V1>0);

V2: Minimum value of the recovery voltage of the pixel of the display element (V2>0);

V3: Light-emitting threshold voltage of the pixel of the display element (V3>0);

V4: Maximum value of the recovery voltage of the pixel of the display element (V4>0);

and in the above:

during a non-lighting period of time between the lighting periods of time of the pixel of the display element, the recovery voltage is applied so as to meet at least the following condition (5), $$\int_{t_0}^{t_0+T} -V(t)dt \geqq L^2/\mu_{max} \quad (5)$$

wherein:

$t_0$: Certain point of time after the pixel has been extinguished;

L: Thickness of the organic layer of the organic light-emitting element;

$\mu_{max}$: Maximum value of the carrier mobility of the organic layer;

T: Certain point of time before the pixel is lit again;

V(t): Voltage waveform applied to the element.

(2) In a display-element drive method according to (1), the gradation or gray scale the display panel is obtained by varying at least the light emission voltage V (t (Aon, Con)).

(3) In a display-element drive method according to (1), the gradation of the display panel is obtained by varying at least the period of time during which the light-emission voltage V (t (Aon, Con)) is applied to the element.

(4) In a display-element drive method according to (1), the display element is driven by adjusting at least the light-emission current V (t (Aon, Con)) so that a constant voltage can be provided to cause the pixel to emit light.

DETAILED DESCRIPTION OF PREFERRED EMBODIMENTS

The light-emission mechanism of the organic light-emitting elements is described below. The area of the organic light-emitting element described below is conceptual and functional, and does not necessarily correspond to the structure of the actual organic light-emitting elements on a one-to-one basis.

Figure 1:
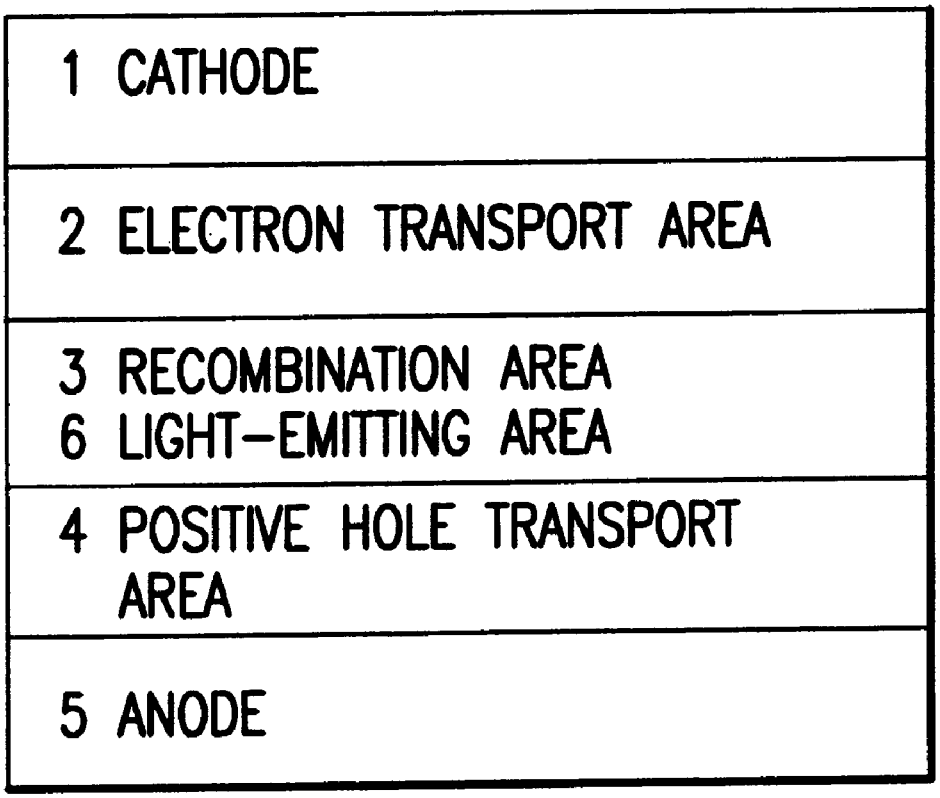
FIG. 1 is an explanatory view for showing an operational principle of an organic light-emitting element.

The function of the organic light-emitting element is described with reference to FIG. 1. When positive and negative voltages are applied to an anode 5 and a cathode 1, respectively, positive holes are injected from the anode and travel to a recombination area 3 through a positive hole transport area 4. In addition, electrons are injected from the cathode and travel to the recombination area 3 through an electron transport area 2. The electron transport area 2 and/or the positive hole transport area 4 may be omitted. The positive holes and electrons, which have reached the recombination area, are re-combined together to generate excitons. The excitons relax and light is emitted in a light-emission area 6 to generate photons.

In this case, the light-emission area may be established in a specific one within the recombination area; or it may be located in the positive hole transport area, the recombination area, or the electron transport area; or extend over a plurality of these areas. Furthermore, it may be a set region of a plurality of these areas. Preferably, the excitons generated in the recombination area relax and emit light as many as possible in the light-emission area. To do this, the organic light-emitting element can have a multilayer structure to provide a barrier against the positive holes or electrons in order to concentrate a particularly large number of positive holes or electrons in a specific region within the element, thereby increasing the probability of recombination. In addition, a material with a particularly high light-emission efficiency may be formed or diffused as a light-emission region near the recombination area to improve the light-emission efficiency.

Parts of the charges (either the positive holes or the electrons) generated by applying a voltage to the element for light emission may be captured by a charge trap site inside the organic light-emitting element and stay there instead of reaching the recombination area where they are recombined together. This may occur in a site called "injection barrier" within the organic light-emitting element, which requires high energy due to the transfer of charges. Such charges are distributed within the organic light-emitting element and change the electric fields inside the element to partially lower the potential gradient. This prevents the charges from being transferred easily, thereby reducing the number of excitons generated and lowering the light-emission intensity of the organic light-emitting element.

If the element is externally measured, this phenomenon appears as an increase in the internal resistance value of the element. Since only the number of changes transferred has decreased without lowering the efficiency of photon generation, the initial brightness can be maintained by, for example, using a constant current drive method to increase the applied voltage in response to changes in the internal resistance. Changing the circuit constant of the element, however, is not preferable in driving the display panel.

In the invention, the recovery voltage expressed by equations (3) and (4) is applied to the organic light-emitting element in order to guide the retained charges in a direction different from the one during the light emission, and to expel finally from the light-emitting element, thereby discharging and deleting the charges captured within the element. To do this, a sufficient recovery voltage to transfer the charges retained within the element from the element must be applied for a sufficient period of time. This invention thus requires that the condition be met for the relations between the recovery voltage and the application time expressed by equation (5).

The recovery voltage need not always be applied during a non-lighting period of time, and the effects of the recovery voltage can be sufficiently provided by selecting a given application period as required.

This invention is described on the basis of the following embodiments.

Embodiment 1

Figure 2:
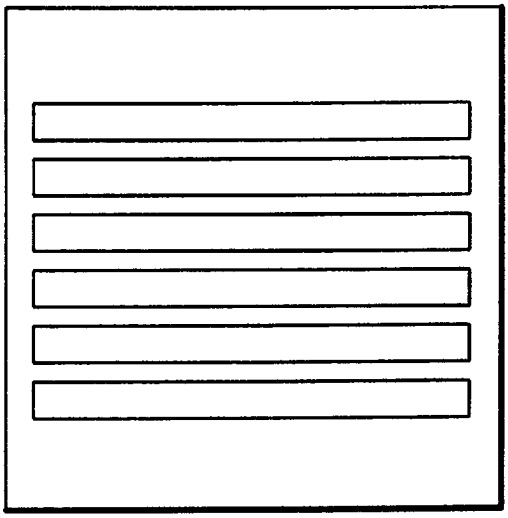
FIG. 2 is an explanatory view for a film formation pattern of an organic light-emitting element according to an embodiment of the invention.
Figure 2:
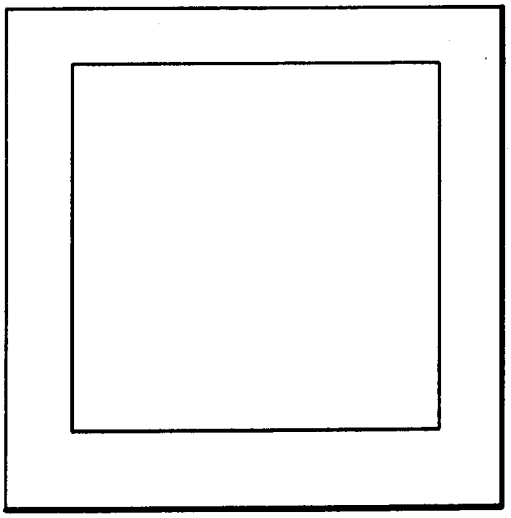
Figure 2:
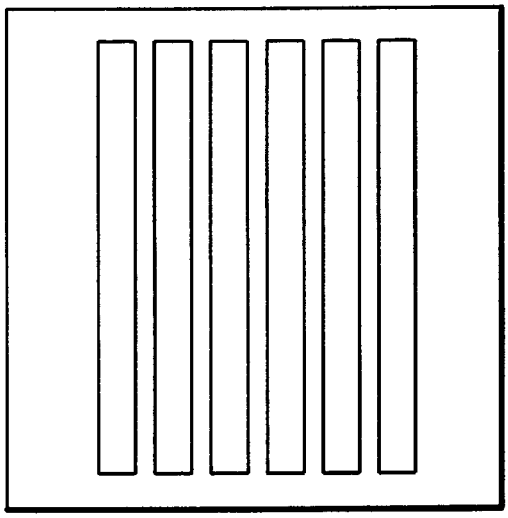
Figure 3:
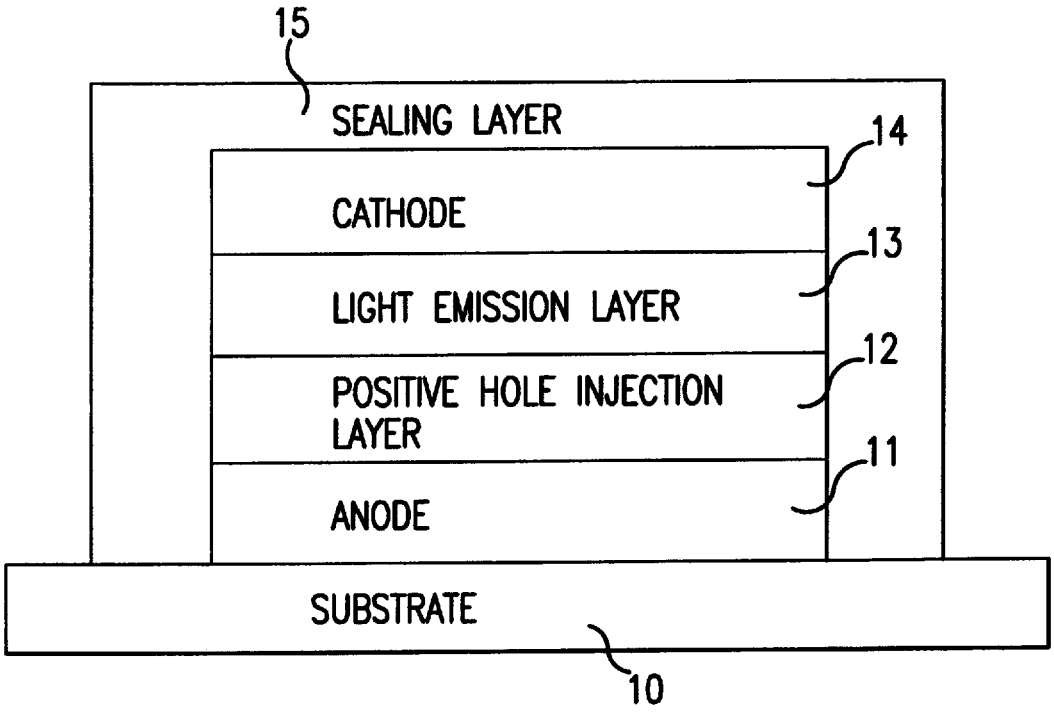
FIG. 3 is a cross-sectional view showing the structure of the organic light-emitting element according to the embodiment.

An organic light-emitting element display panel with 6×6 pixels was used as a display element. The anodes of the light-emitting elements comprised address lines while the cathodes comprised data lines. This is shown in FIG. 2.

To produce a trial element or prototype, a pattern of anodes 11 was first formed on a planar glass substrate 10 with a thickness of 0.5 mm. The anode was made of indium tin oxide (ITO) and had a thickness of 150 nm. A positive hole injection layer 12 and a light-emission layer 13, which are organic material layers, were subsequently formed. These organic material layers had thicknesses of 50 and 70 nm, respectively. The material of the positive hole injection layer 12 was a diamine compound shown by the following structural formula (I).

(I)

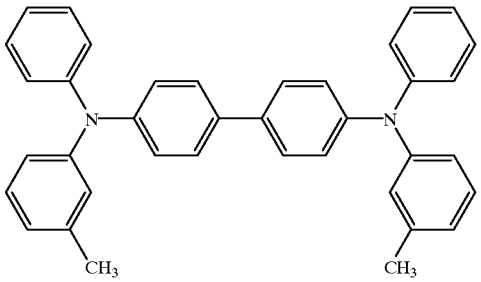

The material of the light-emission layer 13 was an aluminum chelate compound shown by the following structural formula (II).

(II)

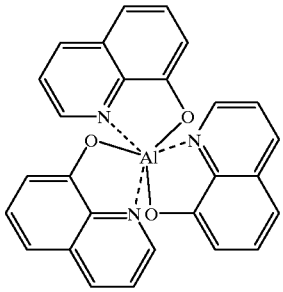

Next, a pattern of the cathodes 14 was formed so as to have a thickness of 200 nm. The material of the cathode 14 was MgIn alloy (containing 5 vol.% of In). Finally, a sealing layer 15 of fluorine-contained resin was formed.

Figure 4:
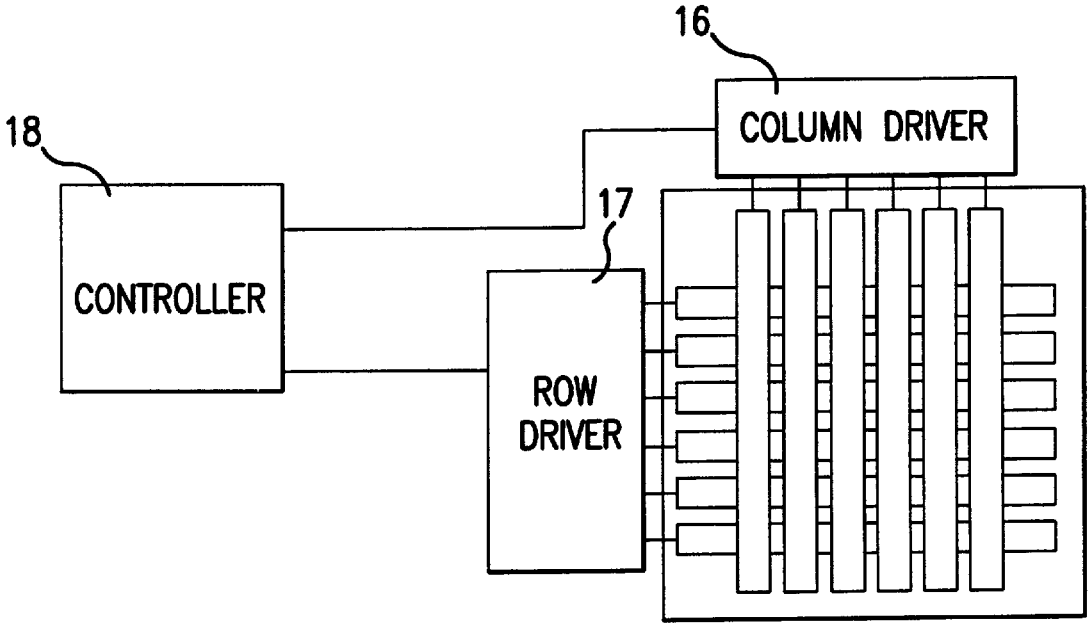
FIG. 4 is an explanatory view for showing a drive mechanism for an organic light-emitting element display panel according to the embodiment.
Figure 5:
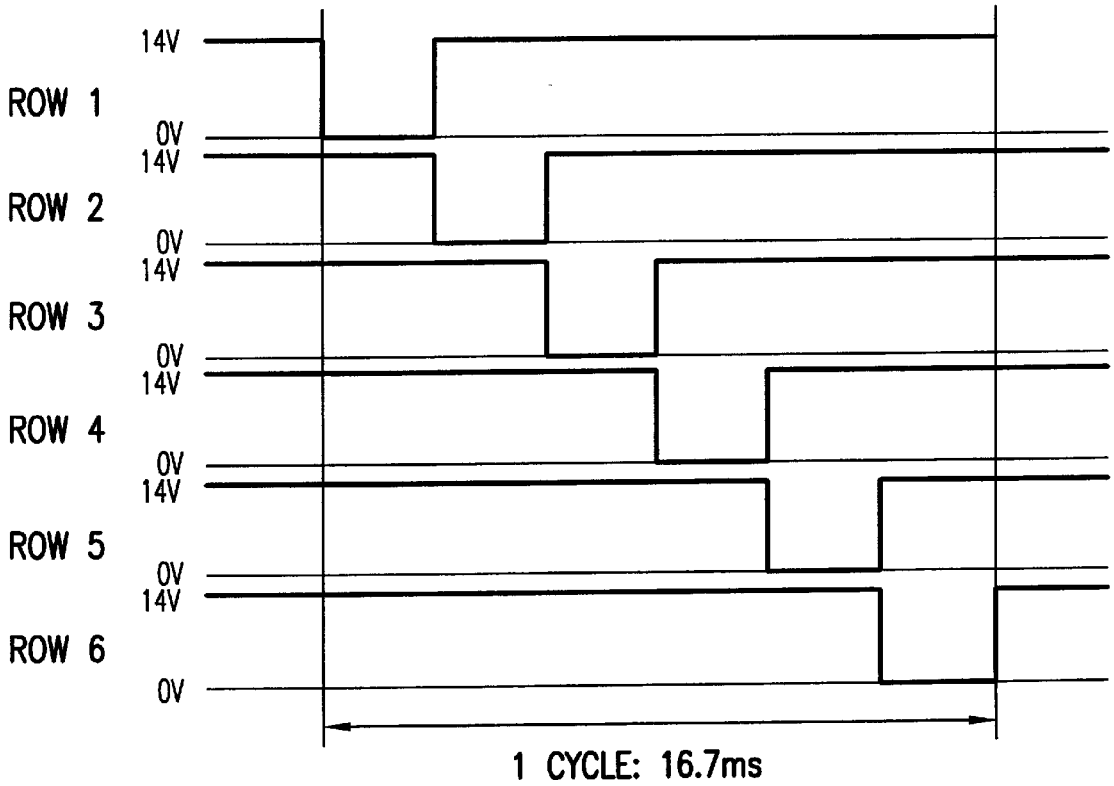
FIG. 5 is a diagram showing a time series of the output voltage of a row driver according to Embodiment 1.

A display control circuit was attached to the display element as shown in the FIG. 4 so that the element could be scanned at a frequency of 60 Hz. A column driver 16 was attached to the data lines comprising the cathodes of the light-emitting element, whereas a row driver 17 was attached to the address lines comprising the anodes. The column and row drivers were controlled by the control circuit 18. A time-series output as shown in FIG. 5 was provided as the output of the row driver. The single frequency was 16.7 ms so that the frame frequency would be 60 Hz. A line emitted light when its voltage became 0 V.

Figure 6:
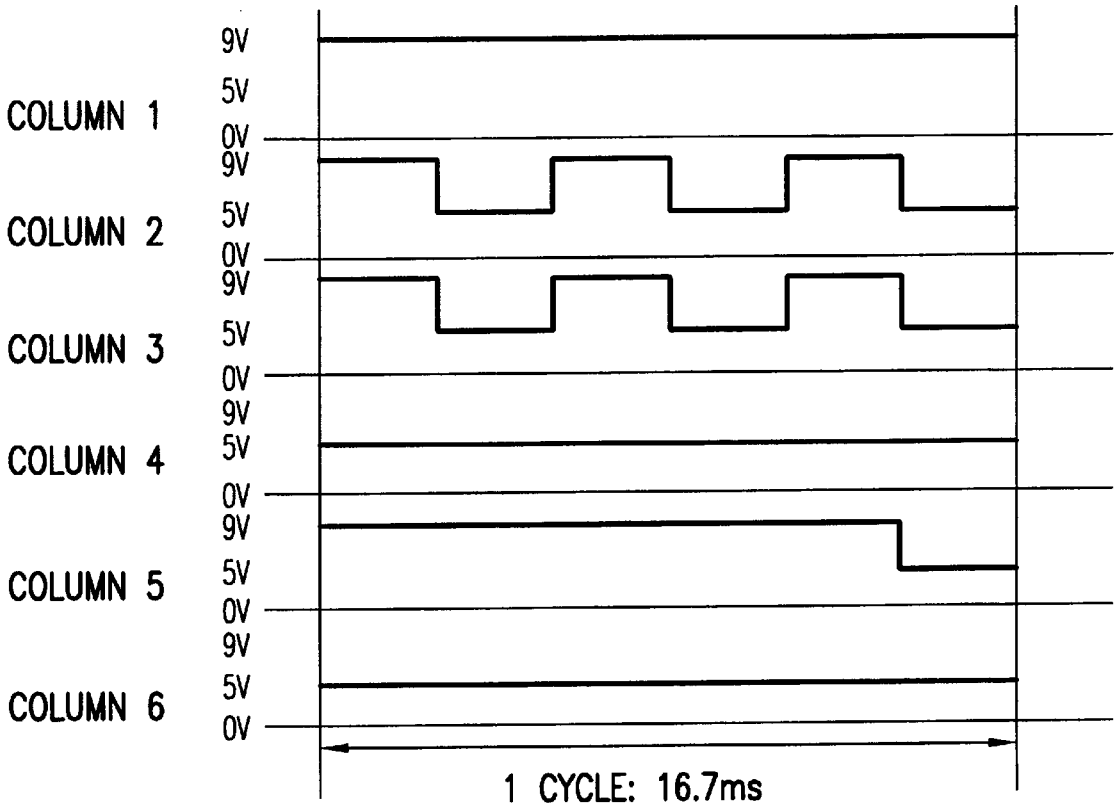
FIG. 6 is a diagram showing a time series of the output voltage of a column driver according to Embodiment 1.
Figure 7:
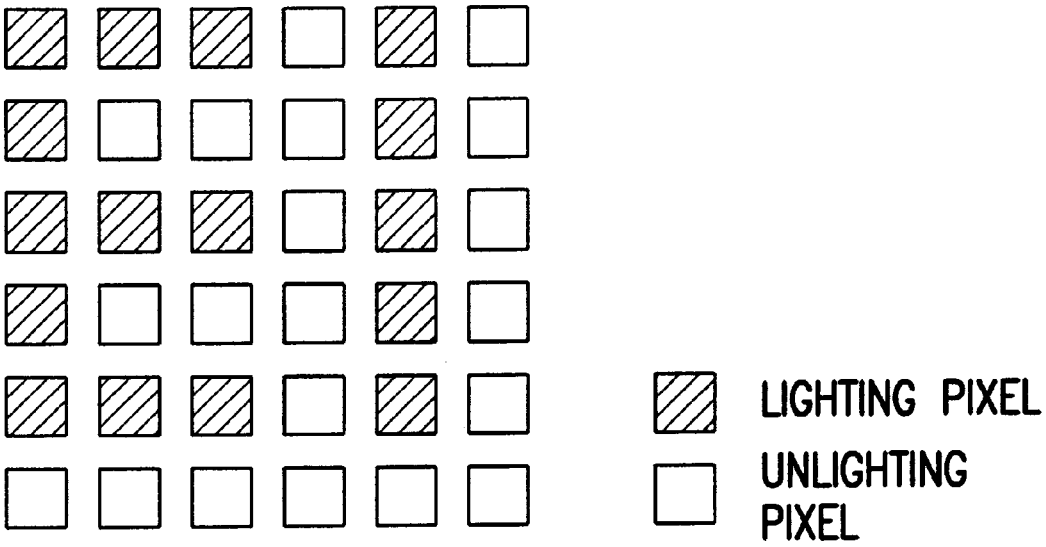
FIG. 7 shows display results according to Embodiment 1.

A time-series output as shown in FIG. 6 was provided as data output. As a result, the lighting on the display panel appeared as shown in FIG. 7. In this case, a voltage of 9 V was applied to the pixels to be lighted, while a voltage of −9 to −5 V was supplied through the data lines to the pixels to be unlighted. The lighted pixels had an average brightness of 100 cd/m$^2$ per hour.

In this case, the recovery voltage that met equations (3) and (4) defined in this invention was applied to each pixel for 13.9 ms; the value of the carrier transfer in the voltage material was $10^{-5}$cms$^{-2}$ at maximum; and the organic layer had a thickness of 120 nm. Thus, the recovery voltage was applied so as to meet equation (5) as defined in this invention.

The element was continuously driven under these driving conditions, and the period of time during which the brightness decreased to half was 124 hours for the top left-most pixel.

COMPARATIVE EXAMPLE 1

Figure 8:
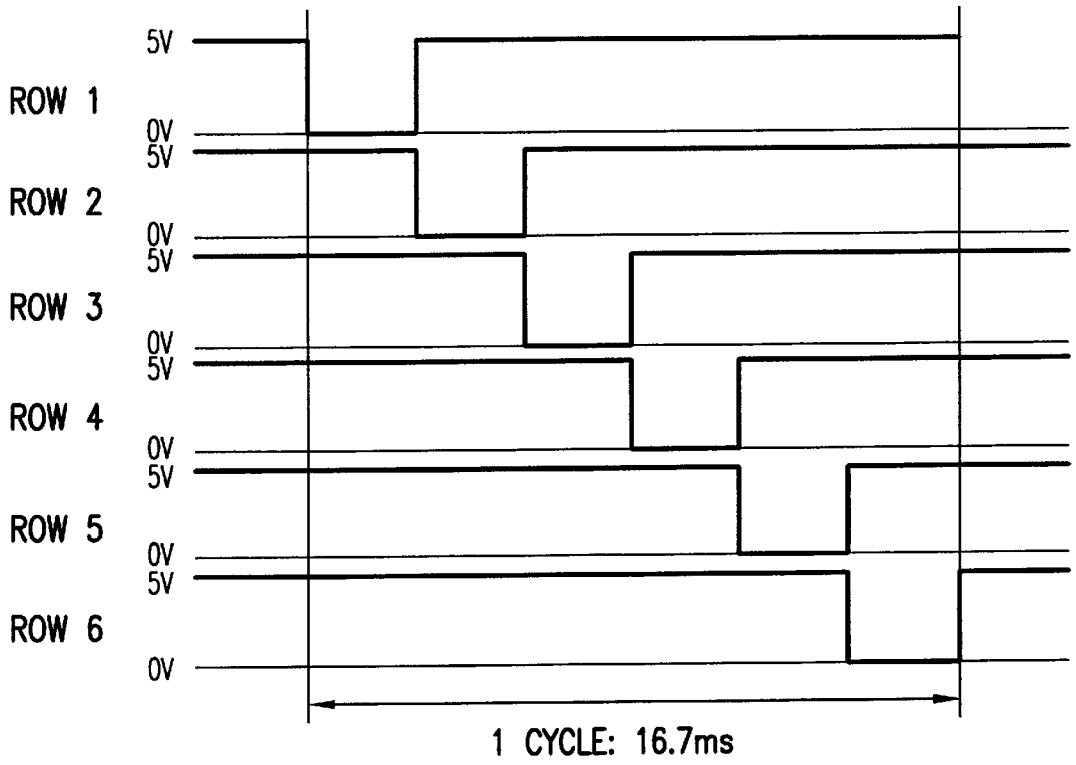
FIG. 8 is a diagram showing a time series of the output voltage of a row driver according to Comparative Example 1.

A display panel was produced in exactly the same manner as in Embodiment 1.The driving method was also the same except for the use of the time series shown in FIG. 8 as the time series of voltage applied to the address lines by the row driver. In this case, a voltage of 9 V was applied to the pixels to be lighted, while a voltage of 0 to 5 V was supplied to the pixels to be unlighted through the data lines. The lighted pixels had an average brightness of 100 cd/m$^2$ per hour.

Under these conditions, the recovery voltage that met equations (3) and (4) defined in this invention was not applied to each pixel so as to meet equation (5) defined in this invention.

The element was continuously driven under these driving conditions, and the period of time during which the brightness decreased to half was 14 hours for the top left pixel.

Embodiment 2

Figure 9:
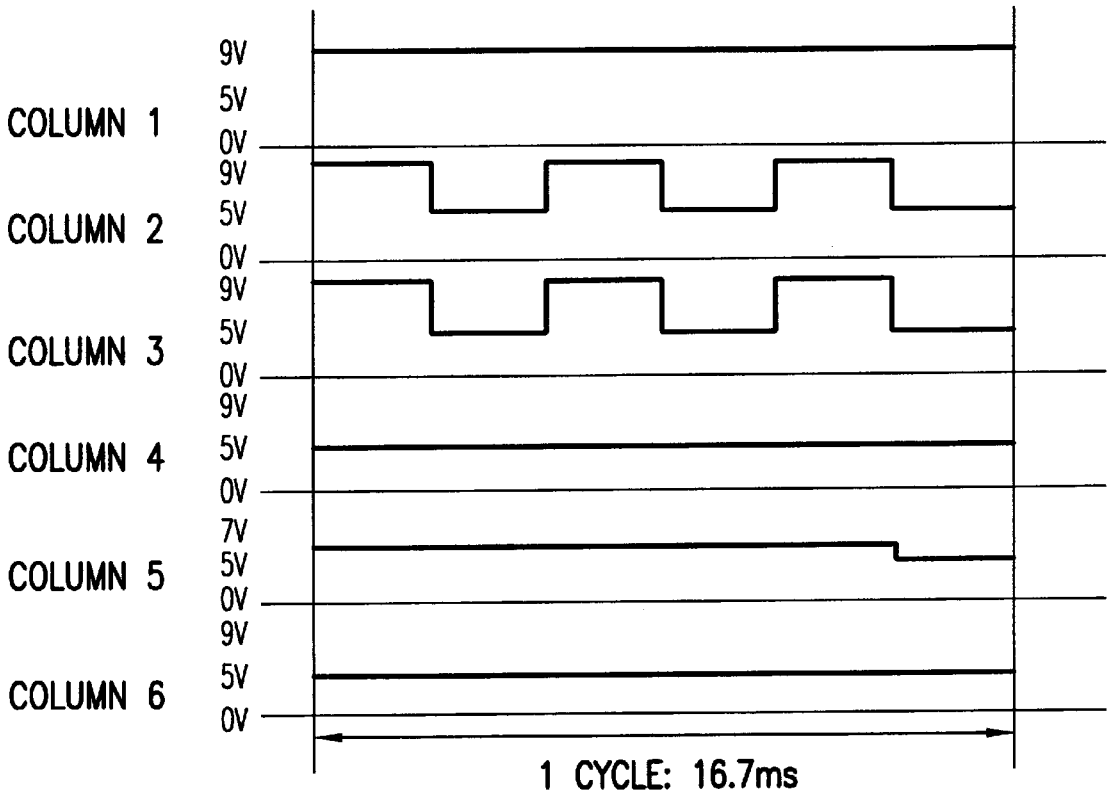
FIG. 9 is a diagram showing a time series of the output voltage of a column driver according to Embodiment 2.
Figure 10:
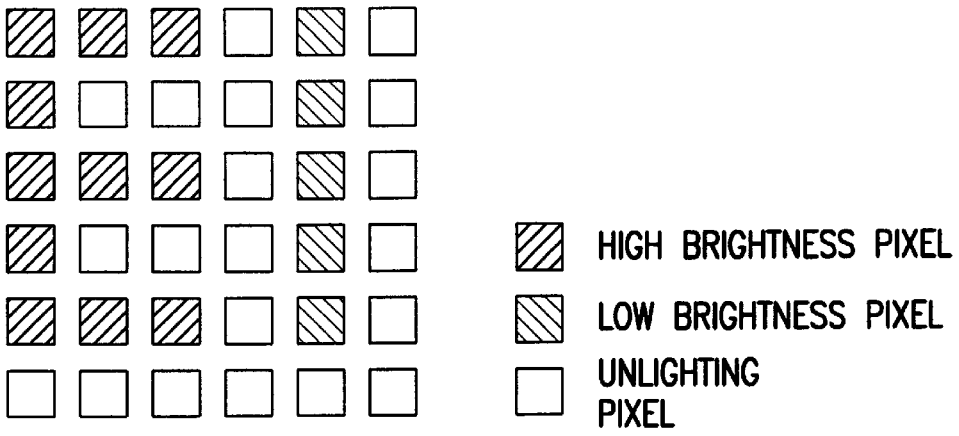
FIG. 10 shows display results according to Embodiment 2.

A display panel was produced in exactly the same manner as in Embodiment 1.The driving method was also the same except for the use of the time series shown in FIG. 9 as the time series of voltage applied to the data lines by the row driver. In this case, a voltage of 9 to 7 V was applied to the pixels to be lighted and gradation was provided as shown in FIG. 10. A voltage of −9 to −5 V was supplied through the data lines to the pixels to be unlighted. The lighted pixels had an average brightness of 100 to 10 cd/m$^2$ per hour.

In this case, the recovery voltage was applied to each pixel so as to meet the equation (5).

The element was continuously driven under these driving conditions, and the period of time during which the brightness decreased to half was 120 hours for the top left pixel.

Embodiment 3

Figure 11:
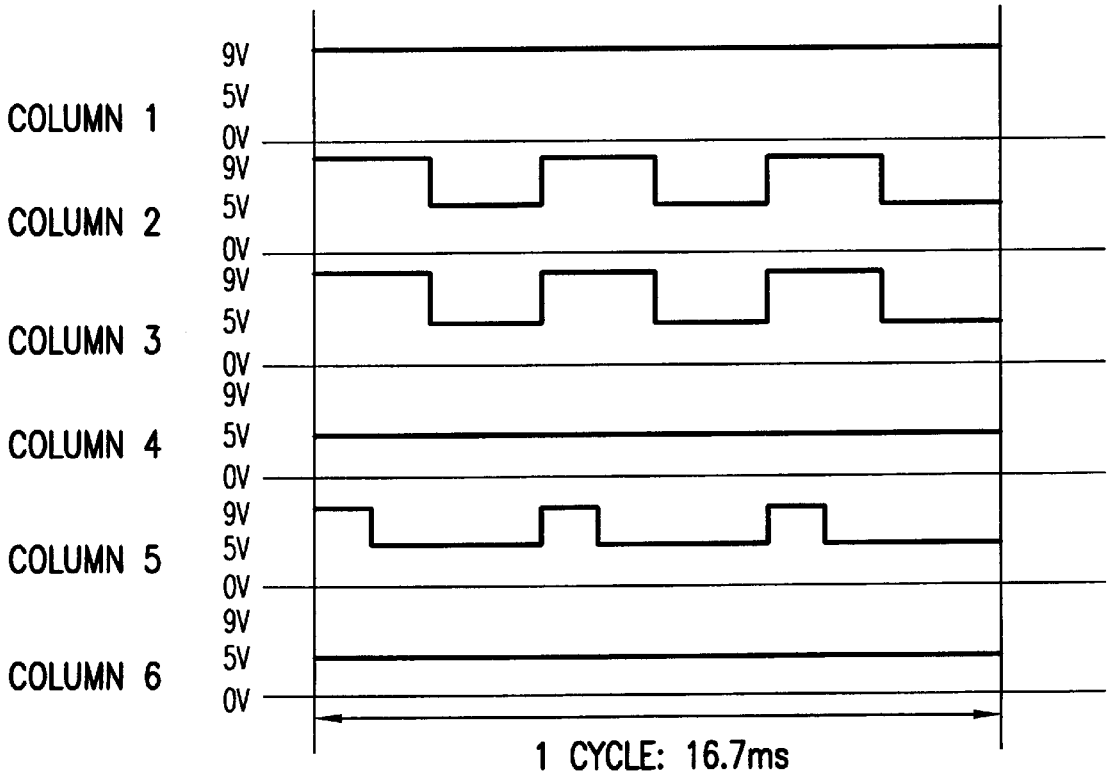
FIG. 11 is a diagram showing a time series of the output voltage of a column driver according to Embodiment 3.
Figure 12:
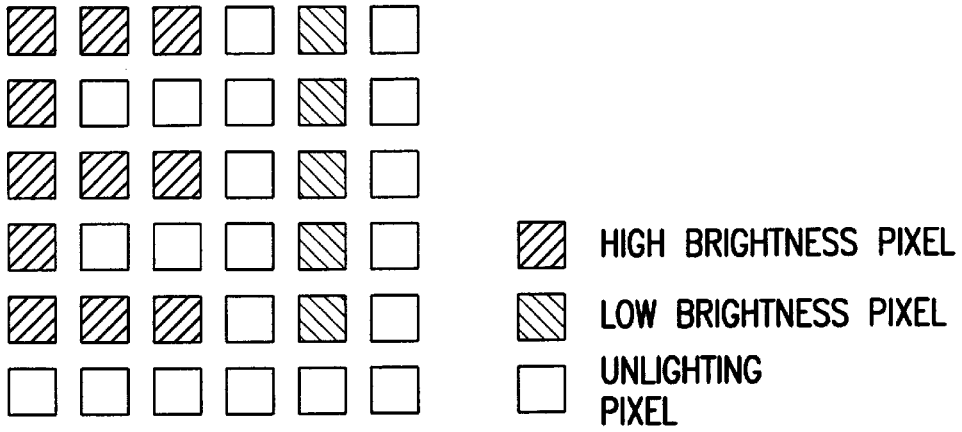
FIG. 12 shows display results according to Embodiment 3.

A display panel was produced in exactly the same manner as in Embodiment 1.The driving method was also the same except for the use of the time series shown in FIG. 11 as the time series of voltage applied to the data lines by the row driver. In this case, a voltage of 9 to 7 V was applied to the pixels to be lighted, and gradation was provided as -shown in FIG. 12. A voltage of 0 to 5 V was supplied through the data lines to the pixels to be unlighted. The lighted pixels had an average brightness of 100 to 10 cd/m$^2$ per hour.

In this case, the recovery voltage was applied to each pixel so as to meet equation (5).

The element was continuously driven under these driving conditions and the period of time during which the brightness decreased to half was 120 hours for the top left pixel.

Embodiment 4

Figure 13:
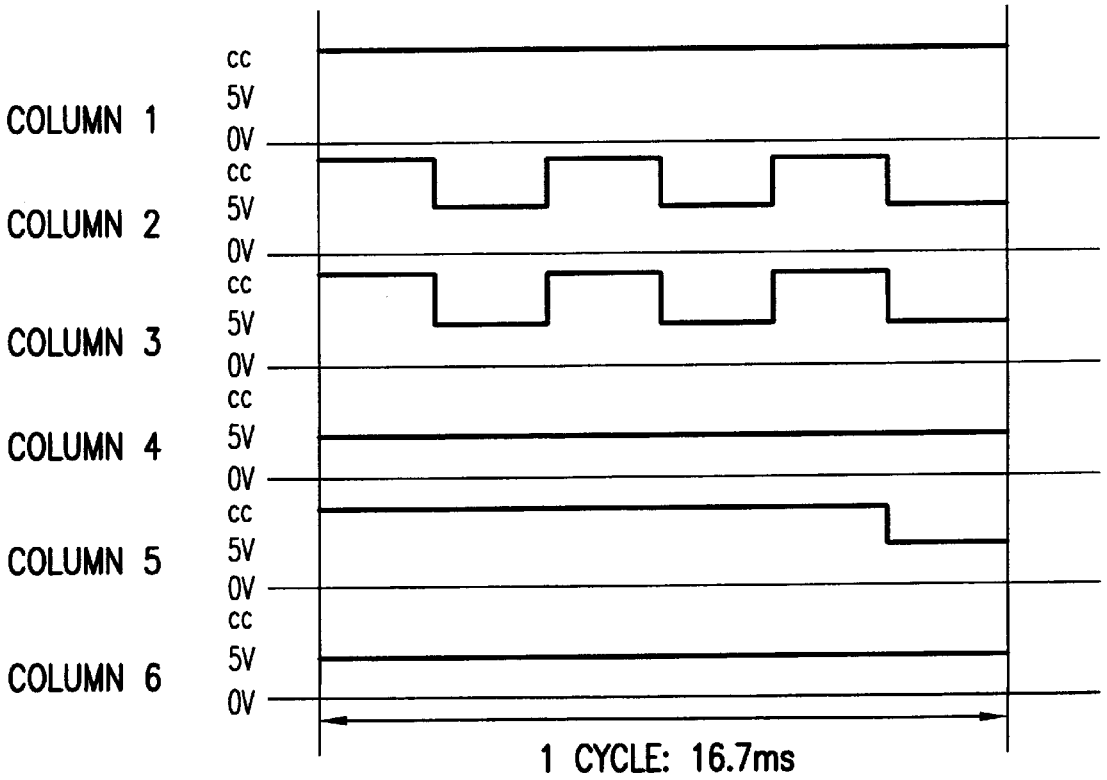
FIG. 13 is a diagram showing a time series of the output voltage of a column driver according to Embodiment 4.

A display panel was produced in exactly the same manner as in Embodiment 1.A constant-current-supplying driver was used as the column driver so as to maintain the current passed by the column drive through the data lines associated with selected pixels at a constant value. A voltage was applied to non-selected pixels. The time series shown in FIG. 13 was used as the time series of applied voltage. In this case, the voltage was applied to the pixels to be lighted so as to provide a constant current. The potentials represented as cc in FIG. 13 indicate that during the corresponding periods of time, the voltage was controlled so as to provide a constant light-emission current. A voltage of −9 to −5 V was supplied through the data lines to the pixels to be unlighted. The lighted pixels had an average brightness of 100 cd/m$^2$ per hour.

In this case, the recovery voltage was applied to each pixel so as to meet equation (5).

The element was continuously driven under these driving conditions, and the period of time during which the brightness decreased to half was 180 hours for the top left pixel.

According to this invention, in a method for driving a display element comprising an organic light-emitting element that emits light by passing a current through an organic thin film, a voltage VC applied to the cathodes of the organic light-emitting elements and a voltage VA applied to the anodes of the organic light-emitting elements are applied to the respective surfaces of the organic thin film through two lines that cross each other, and the display of the pixel in the intersection of the two lines is controlled by electric signals through the two lines. The organic light-emitting element is driven with each applied voltage maintained within the range meeting the above equations (1) to (5), thereby preventing sticking and brightness from decreasing, and providing a long life expectancy.

What is claimed is:

1. A method for driving a display element comprising organic light-emitting elements for emitting light by currents applied to the light-emitting elements, wherein a voltage VC is applied to cathodes of the organic light-emitting elements and a voltage VA is applied to anodes of the organic light-emitting elements through anode and cathode lines crossing each other, and wherein a display of a pixel at an intersection of the anode and cathode lines is controlled by electric signals through the two lines, said method comprising, applying voltages through said anode and cathode lines to the pixels to have following conditions:

$$0 < V(t(Aon, Con)) \leq V1 \quad (1)$$

$$V(t(Aon, Coff)) \leq V3 \quad (2)$$

$$V(t(Aoff, Con)) \leq -V2 \quad (3)$$

$$-V4 \leq V(t(Aoff, Coff)) \leq -V2, \quad (4)$$

V(t): Voltage applied to the pixel, t (Aon, Con): Period of time during which the pixel emits light, t (Aoff, Con): Period of time during which a light-emitting pixel is included on the cathode line of the pixel, t (Aon, Coff): Period of time during which the light-emitting pixel is included on the anode line of the pixel, t (Aoff, Coff): Period of time during which the light-emitting pixel is not included on the anode or cathode line of the pixel, V1: Voltage for obtaining required brightness of the pixel of the display element (V1>0), V2: Minimum value of recovery voltage of the pixel of the display element (V2>0), V3: Light-emitting threshold voltage of the pixel of the display element (V3>0), V4: Maximum value of the recovery voltage of the pixel of the display element (V4>0), wherein the recovery voltage is applied to the pixel during a non-lighting period of time between lighting periods of time of the pixel of the display element, which meets at least following condition (5), $$\int_{t_0}^{t_0+T} -V(t)dt \geq L^2 / \mu_{\max} \quad (5)$$

$t_0$: Certain point of time after the pixel has been extinguished,

L: Thickness of the organic layer of the organic light-emitting element, $\mu_{max}$: Maximum value of carrier mobility of the organic layer, T: Certain point of time before the pixel is lit again, V(t): Voltage waveform applied to the element.

2. A display element drive method according to claim 1, wherein gradation of the display panel is obtained by varying at least the light emission voltage V (t (Aon, Con)).

3. A display element drive method according to claim 1, wherein gradation of the display panel is obtained by varying at least the period of time during which the light emission voltage V (t (Aon, Con)) is applied to said element.

4. A display element drive method according to claim 1, wherein the display element is driven by adjusting at least the light emission voltage V (t (Aon, Con)) to have a constant current to cause said pixel to emit light.

* * * * *

UNITED STATES PATENT AND TRADEMARK OFFICE

CERTIFICATE OF CORRECTION

PATENT NO : 6,104,363

DATED : August 15, 2000

INVENTOR(S) : Makoto Kobayashi, Haruo Kawakami, Yotaro Shiraishi

It is certified that error appears in the above-identified patent and that said Letters Patent are hereby corrected as shown below:

In column 2, line 62, after "scale" add --of--;

In column 3, line 3, change "current" to --voltage--;

line 4, change "voltage" to --current--;

In column 5, line 38, change "the Fig. 4" to --Fig. 4--;

and line 41, change "element" to --elements--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*